US007746297B2

(12) United States Patent
Hirakawa et al.

(10) Patent No.: US 7,746,297 B2
(45) Date of Patent: Jun. 29, 2010

(54) GAS DISCHARGE DISPLAY METHOD USING BOTH SURFACE AND OPPOSING DISCHARGES SEPARATELY TO EMIT LIGHT IN THE SUSTAIN PERIOD

(75) Inventors: Hitoshi Hirakawa, Takasago (JP); Manabu Ishimoto, Kobe (JP); Kenji Awamoto, Miki (JP)

(73) Assignee: Shinoda Plasma Corporation, Hyogo (JP)

( * ) Notice: Subject to any disclaimer, the term of this patent is extended or adjusted under 35 U.S.C. 154(b) by 892 days.

(21) Appl. No.: 11/277,370

(22) Filed: Mar. 24, 2006

(65) Prior Publication Data

US 2006/0220993 A1 Oct. 5, 2006

(30) Foreign Application Priority Data

Mar. 29, 2005 (JP) ..... 2005-096416

(51) Int. Cl.
*G09G 3/28* (2006.01)

(52) U.S. Cl. ..... 345/63; 345/60; 345/67; 345/68; 315/169.4

(58) Field of Classification Search ..... 345/60–72; 315/169.3–169.4
See application file for complete search history.

(56) References Cited

U.S. PATENT DOCUMENTS

2002/0180664 A1* 12/2002 Tomida et al. ..... 345/31
2003/0122485 A1 7/2003 Tokai et al.
2004/0051470 A1* 3/2004 Hashimoto et al. ..... 315/169.3
2004/0233128 A1* 11/2004 Choi et al. ..... 345/60
2005/0052356 A1* 3/2005 Chung et al. ..... 345/60
2005/0110713 A1* 5/2005 Chung et al. ..... 345/60

FOREIGN PATENT DOCUMENTS

JP 2003272561 A * 9/2003
JP 2003272562 A * 9/2003
KR 10-2005-0020046 3/2005

OTHER PUBLICATIONS

Office Action issued Jun. 13, 2008 in corresponding Chinese Patent Application No. 200610066829.7.

* cited by examiner

*Primary Examiner*—Amare Mengistu
*Assistant Examiner*—Gene W Lee
(74) *Attorney, Agent, or Firm*—Staas & Halsey LLP

(57) ABSTRACT

The present invention provides a method of driving a gas discharge display apparatus for displaying gray-scale display levels finer than those achieved by the conventional methods, and also to provide a gas discharge display apparatus with a driver capable of performing such a driving method. An opposed discharge between the sustaining electrode and the address electrode in addition to the conventional surface discharge is generated for the light emission from the fluorescent material in light emitting tubes. The method and the apparatus effect improvements in finer gray-scale display levels than those by the conventional methods.

8 Claims, 10 Drawing Sheets

GAS DISCHARGE DISPLAY METHOD USING BOTH SURFACE AND OPPOSING DISCHARGES SEPARATELY TO EMIT LIGHT IN THE SUSTAIN PERIOD

BACKGROUND OF THE INVENTION

1. Field of the Invention

The present invention relates to a method of driving a gas discharge display apparatus and the apparatus. The gas discharge display apparatus comprises a plurality of light-emitting tubes which are aligned and adhered to sheets having electrodes thereon, where each of the tubes forms a discharge space and includes a discharge gas and fluorescent material therein. The invention more particularly relates to the method of driving the apparatus which applies a voltage between a displaying electrode and an address electrode, both of which are orthogonally opposed each other via the discharge space, for making the fluorescent material emit light, and the apparatus.

2. Description of the Related Art

A display apparatus using gas discharge tubes, as one of the gas discharge display apparatus, is disclosed in the Japanese publication of unexamined application 2003-203603. The gas discharge tube has the structure in which a fluorescent material and a discharge gas are disposed or confined in a grass tube of a small diameter, and then a plurality of the tubes are aligned to form a display panel. Therefore, the large size display with the tubes has characterized in less process for assembling the display, smaller weight, and easiness for assembling for various sizes of screen.

In the display apparatus described above, a triple-electrode surface-discharge structure is adopted. That is, a plurality of the pairs of display electrodes are formed on an inner surface of a front substrate in such a direction as to be orthogonal to the longitudinal direction of the gas discharge tube at every scanning line of matrix display, for yielding a discharge in the tube. A plurality of address electrodes are provided on an inner surface of a rear substrate so as to intersect orthogonally to the display electrode pairs.

In the display apparatus described above using the gas discharge tubes, the pair of the display electrodes and the address electrode define the light-emitting region (also referred to as a cell hereinafter) from which light is emitted. Since the intensity of the light is defined the single discharge between the pair of display electrodes (also the discharge between the sustaining electrodes is referred to as sustaining discharge, and the display electrode also is referred to as the sustaining electrode), the intensity of light emitted from the fluorescent materiel in the cell is fixed. Since the intensity of light caused by single discharge is fixed, the method to perform the gray-scale display is explained with FIG. 1 which shows the structure of one field in display. In the case of displaying an image with 256-level gray-scale, for example, a screen (one field) is composed of several fields 600, and the field 600 is divided into eight subfields sf. Each subfield is composed of a reset period, an address period, and a sustaining period. The reset period is a period for erasing the wall charge for exerting the charge state in each of cells to the same state to avoid the effect of lighting in the previous sustaining period. The address period is a period for selecting a cell to be lit by addressing discharge (also referred to as an opposed discharge) between an address electrode and one of the pair of display electrodes corresponding to the cell, then the charge is accumulated at a portion of the tube close to the display electrode served in the opposed discharge. And for a gray-scale display, the ratio of the number of discharges between a pair of display electrodes for lighting during a sustaining period in each subfield is set as 1:2:4:8:16:32:64:128 so as to realize the relative ratio of brightness as 1:2:4:8:16:32:84:128. That is, the each subfield is a period in which an image of a gray-scale level is displayed.

FIG. 2 shows details of the sustaining period shown in FIG. 1. The waveforms of pulses applied to the sustaining electrodes X and Y shown in FIG. 2 are conventionally used during the sustaining period. The waves shows example of waveforms of voltage applied to the address electrode A, the sustaining electrodes X or Y, respectively, where the sustaining electrodes X and Y compose a pair of display electrode. At the timing the pulse 660 being applied to the sustaining electrode X, the positive wall charge has been accumulated on the dielectric member, such as the grace glass of tube, close to the sustaining electrode X, while the negative wall charge has been accumulated on the dielectric member close to the sustaining electrode Y. Then the actual applied voltage on the sustaining electrode X is sum of voltage by the pulse 660 and the wall charge close to the electrode X when the pulse 660 is applied to the sustaining electrode X, while the actual voltage of the sustaining electrode Y is negative because of negative wall charge close to the sustaining electrode Y. Therefore, a voltage higher than the value of the pulse 660 is applied between the sustaining electrodes X and Y, and then the sustaining discharge is initiated between them. After this sustaining discharge, the negative wall charge is accumulated on the portion close to the sustaining electrode X and positive wall charge is accumulated on the portion close to the sustaining electrode Y. And then when the pulse 670 is applied to the sustaining electrode Y, the sustaining discharge is generated between the sustaining electrodes X and Y. Thus at each when time pulses 662, 672, 664, 674, 666, 676 are alternatively applied to the respective sustaining electrodes X or Y, the sustaining discharge is generated. The discharge generates the ultraviolet rays which make the fluorescent material glow in turn. As described above, the gas discharge display apparatus of the triple-electrode surface-discharge type performs a gray scale display with varying the number of sustaining discharges between the pair of display electrodes. However, the brightness to be displayed is limited to integral multiple of a brightness caused by single sustaining discharge. Therefore the conventional gas discharge display apparatus can perform the gray-scale display which is limited within the integral multiple of the gray-scale display level corresponding to the brightness caused by the single sustaining discharge. That is, the realization of a continuously smooth gray-scale display level is difficult for the conventional gas discharge display apparatus.

SUMMARY OF THE INVENTION

An object of the present invention, therefore, is to provide a method of driving a gas discharge display apparatus for displaying gray-scale display levels finer than those and the conventional methods, and also to provide a gas discharge display apparatus with a driver capable of performing such a driving method.

According to one aspect of the present invention, a method of driving a gas discharge display apparatus is provided. The apparatus comprises a plurality of tubes in which a discharge gas is filled and fluorescent material is disposed and the discharge space is formed, and a pair of display electrodes and an address electrode are opposed each other via the discharge space. The method of driving realizes that one or more discharges between one of the pair of the display electrodes and the address electrode is performed during the sustaining period in which the discharge between the pair of the display electrodes makes the fluorescent glow.

Further, adding to the method of driving described above, an opposed discharge between one of the pair of the display electrodes and the address electrode can be performed by applying a pulse signal on an address electrode during the sustaining period.

Further, adding to the method of driving described above, when a polarity of the pulse signal to be applied to the address electrode is positive, a peak value of the pulse signal is equal to or larger than an addressing pulse that is applied during an addressing discharge.

Further, adding to the aspect, a discharge between the pair of the display electrodes is protected when it has been discharging between one of the pair of the display electrodes and the address electrode is exerted (executed).

Further, adding to the method of driving described above, pulses having same polarity are applied on both the pair of display electrodes.

Further, adding to the method of driving, an opposed discharge between one of the pair of the display electrodes and the address electrode is executed during a sustaining period in arbitrary one or more of subfields which compose one field.

Further, addition to the method described above, an opposed discharge between one of the pair of the display electrodes and the address electrode is executed during a sustaining period in only arbitrary one or more of subfields which compose one field, while in the sustaining period a discharge for display between a pair of display electrodes is not executed.

According to other aspect of the present invention, a gas discharge display apparatus is driven by one of the methods of driving described above.

The present invention allows the finer gray-scale display levels than those provided by conventional gas discharge display devices, because the present invention provides a method of driving a gas discharge display apparatus and the apparatus of making fluorescent material glow by executing discharge between a sustaining electrode and an address electrode in addition to a surface discharge between sustaining electrodes.

DESCRIPTION OF THE PREFERRED EMBODIMENTS

First Embodiment

Figure 1:
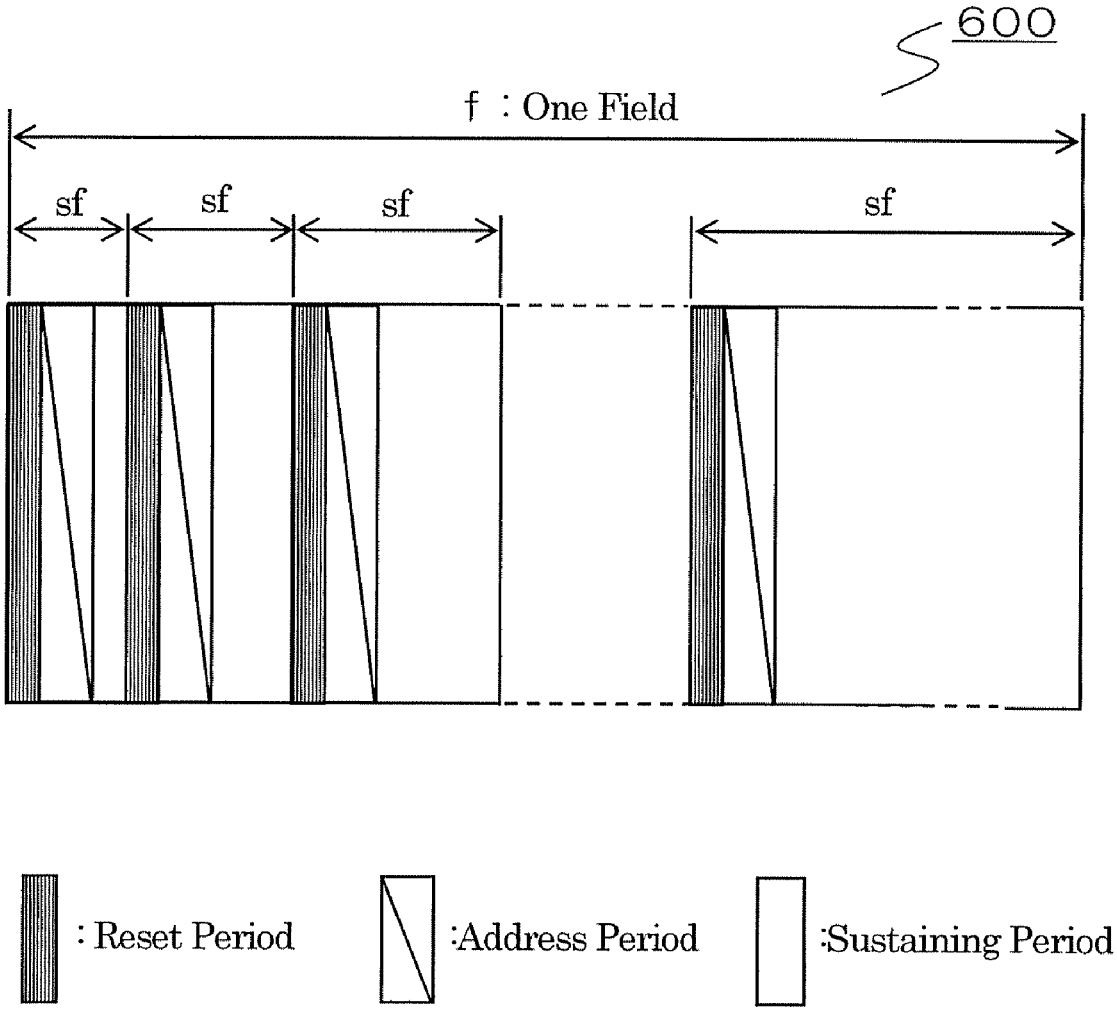
FIG. 1 is a timing chart concerning one field including a reset, a sustaining, and a sustaining periods.
Figure 2:
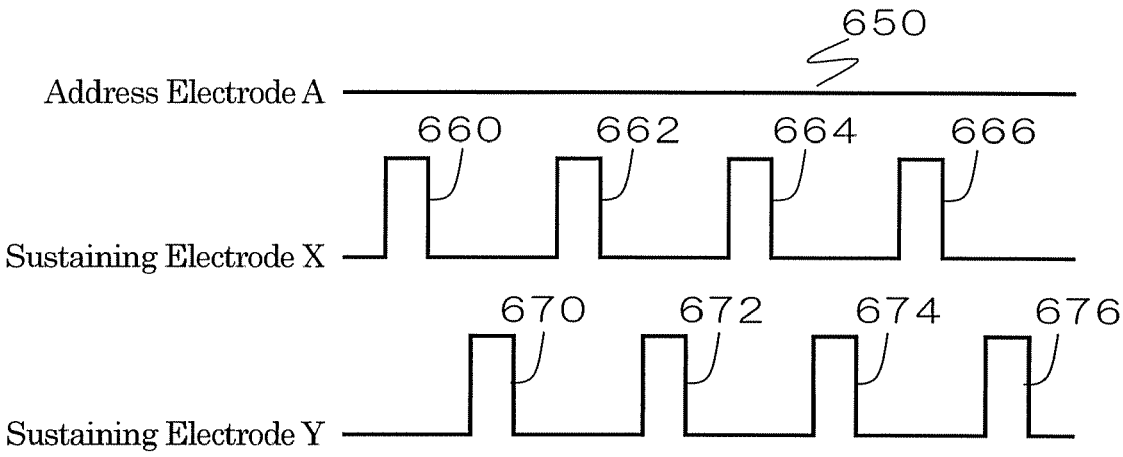
FIG. 2 shows conventional sustaining pulses applied to display electrodes X, Y during a sustaining period.
Figure 3:
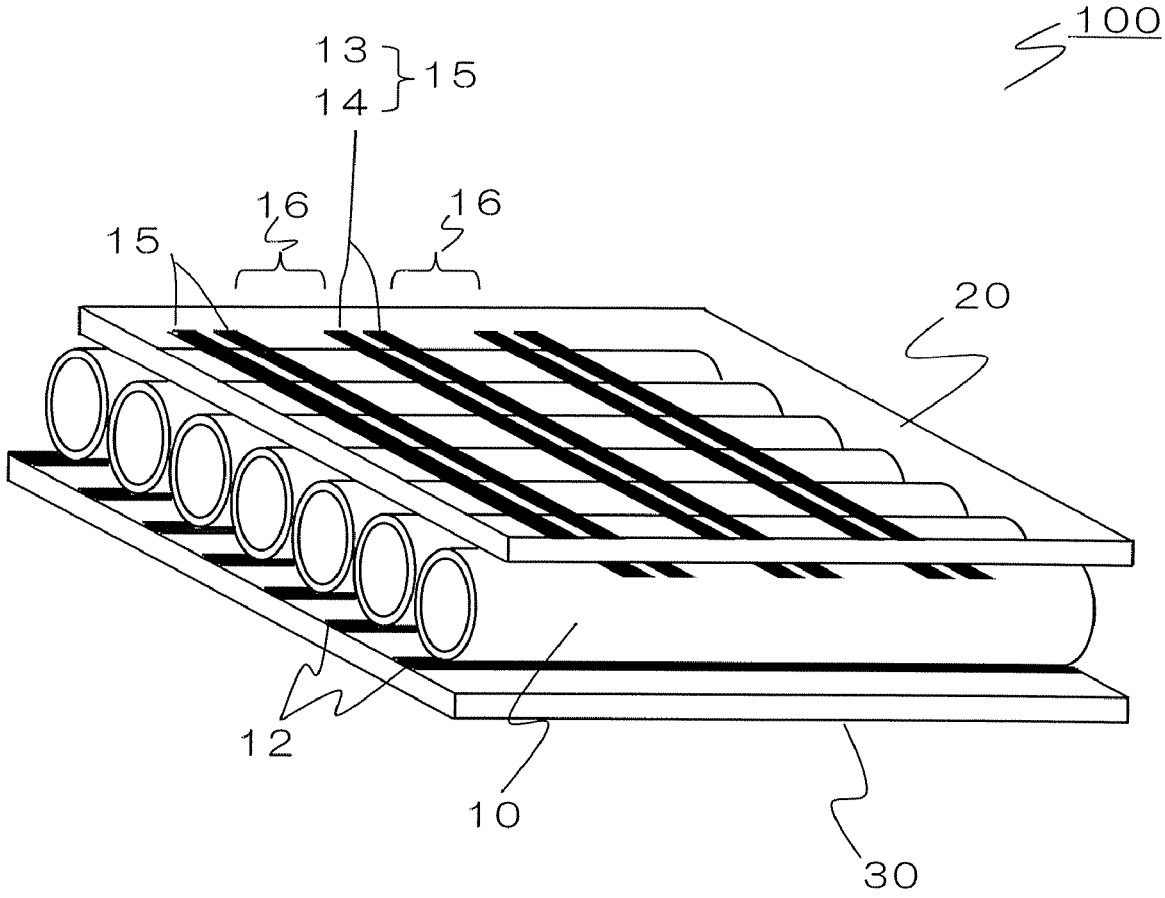
FIG. 3 shows a schematic view concerning a gas discharge tube array.

The gas-discharge-tube display array as the preferred embodiment of present invention is shown in FIG. 3. The gas-discharge-tube display array 100 comprises a plurality of tubes in which a discharge gas is filled and fluorescent material is disposed inside to form a discharge space. The electrodes for displaying are provided outside the plurality of the tubes aligned. The gas discharge tube 10 is made of glass and has a diameter of approximately 0.5 to 5 mm, and secondary electron emitting membrane, such as MgO membrane, is formed on the inner surface of the glass tube of the gas discharge tube 10. Further in the tube 10, fluorescent material and the discharge gas (for example, the discharge gas is a mixture of 96 percent Ne and 4 percent Xe) are disposed or filled inside, then the both ends of the tube 10 are sealed. The gas-discharge-tube display-array 100 comprises a front substrate 20, a rear substrate 30, and the plurality of gas discharge tubes 10 aligned disposed therebetween. On the front substrate 20, a plurality of the pairs of display electrodes 15 are formed in the orthogonal direction to the longitudinal direction of the gas discharge tube 10. Non-luminous areas 16 are provided each between the pair of the display electrodes 15. On the rear substrate 30, the address electrodes 12 are formed in the longitudinal direction of each gas discharge tube 10. The pair of display electrodes 15 and the address electrodes 12 are assembled so as to bring close contact with the upper outer periphery or the gas discharge tubes 10 or with the lower outer periphery of the tube 10 respectively, during the gas-discharge-tube display-array 100 being assembled. To improve the adhesion between the electrodes 12 and 15 and the gas-discharge tubes 10, an electro-conductive adhesive agent can be used between the electrodes and the gas-discharge tubes, further the transparent agent is preferable as the adhesive agent.

A transparent material is desirable as a member of the front substrate 20, further a flexible and transparent substrate material such as PET (Polyethylene terephthalate) is preferable to improve the adhesive quality between the gas discharge tubes 10 and the plurality of the pairs of display electrodes 15. As the substrate material for the rear substrate 30, the glass sheet or the PET can be also used, while the PET is preferable for the material of the rear substrate. The flexible substrate such as PET is preferable as the substrate material for both of the front and rear substrates 20 and 30, while the flexible substrate can be used as one of both substrates 20 and 30. Further, to improve the adhesion between the gas-discharge tubes 10 and the front or rear substrates 20, 30, it is preferable to glue them by a transparent insulating adhesive agent.

The portion where the address electrode 12 and the pair of display electrodes 15 cross is a cell as a unit luminous region in plane view. When displaying, one of the pair of display electrodes 15 is served as a scanning electrode, and the selective discharge for selecting cells as regions to be lit is performed at the portions where the one display electrode and each address electrode 12 cross. The resultant wall charge accumulated on the inner surface of the tube close to the cells caused by the selective discharge is used to generate sustaining discharge between a pair of display electrodes 15. The selective discharge is an opposed discharge in the gas discharge tube 10 between the scanning electrode and the address electrode 12 which oppose each other upward or downward in FIG. 3. The displaying discharge is the surface discharge between the sustaining electrodes X 13 and Y 14 which are parallel each other and compose the pair of display electrodes 15.

Figure 4:
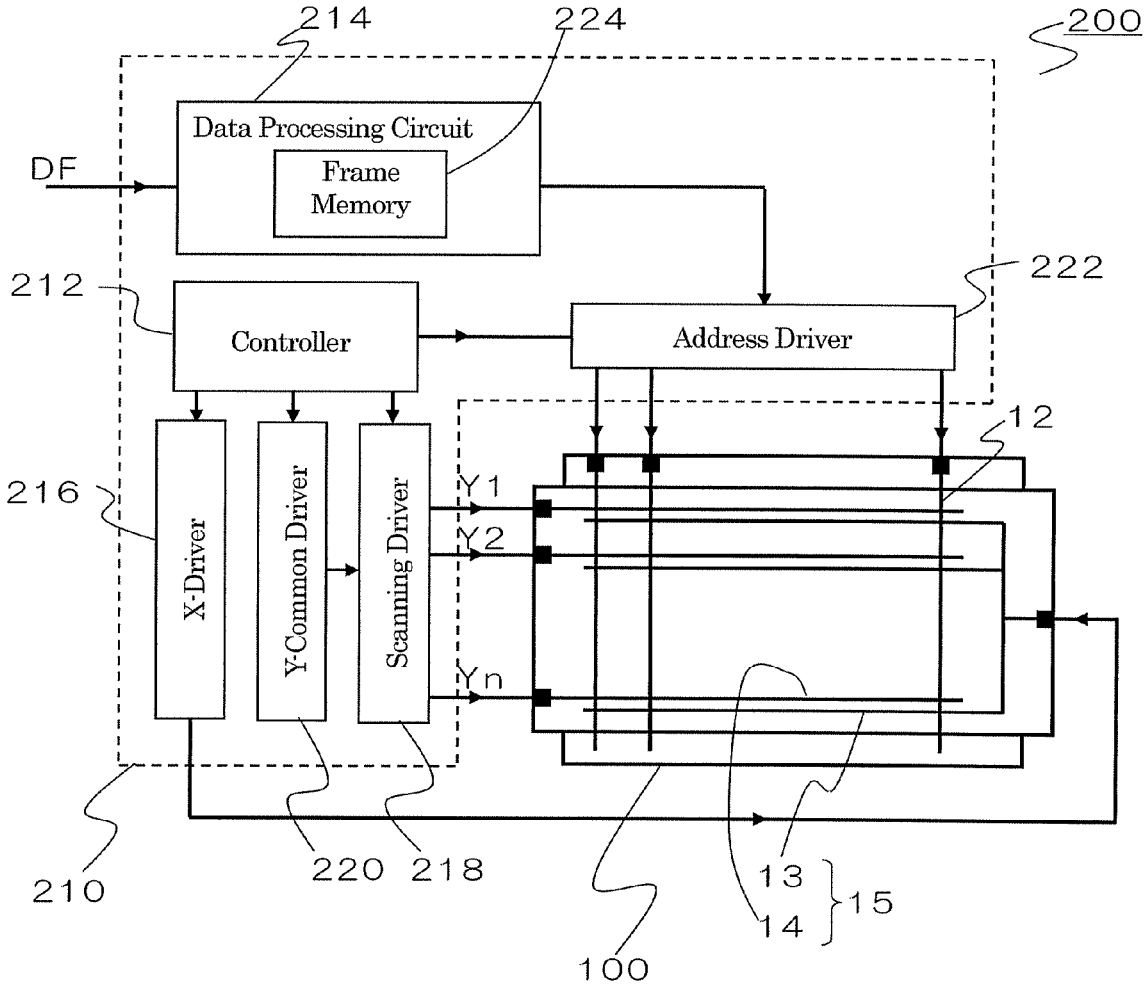
FIG. 4 shows a diagram showing overall configuration of a gas discharge display apparatus.

FIG. 4 shows a schematic configuration of the gas discharge display apparatus 200 in which the gas-discharge-tube display-array 100 is used. The gas discharge display apparatus 200 is composed of the gas-discharge-tube display-array 100 and a driving unit 210. In this embodiment, the plurality of the pairs of display electrodes 15 are extended in the line direction of the screen of the apparatus 200, and the sustaining electrode Y 14 of each of the pairs 15 is used as a scanning electrode which serves to select cells to be lit at every line during the address period. The address electrodes 12 extend in the row direction (an orthogonal direction to the direction of line) and serve as electrodes for selecting cells to be lit at every row during the address period. The driving unit 210 comprises a controller 212, a data processing circuit 214, an X driver 216, a scanning driver 218, Y-common driver 220, an address driver 222, a power unit circuit (not shown) and the like. The field data DF which indicates brightness levels (gray-scale levels) (in a case of color display, brightness levels of each color of red, green, and blue) of every pixel, is input to the driving unit 210 together with various synchronizing signals from external devices, such as TV tuner or a computer. The field data DF is once stored in a field memory 224 in the data processing circuit 214, and then is processed for converting the data DF to the data for displaying the gray-scale display and stored in the field memory 224 again. At adequate timing, the data is transferred to the address driver 222.

The X driver 216 applies a driving voltage to every sustaining electrode X 13. The scanning driver 218 applies individually a driving voltage to each sustaining electrode Y 14 during the address period. The Y-common driver applies a driving voltage to all sustaining electrodes Y 14 at the same time during sustaining the glow.

Figure 5:
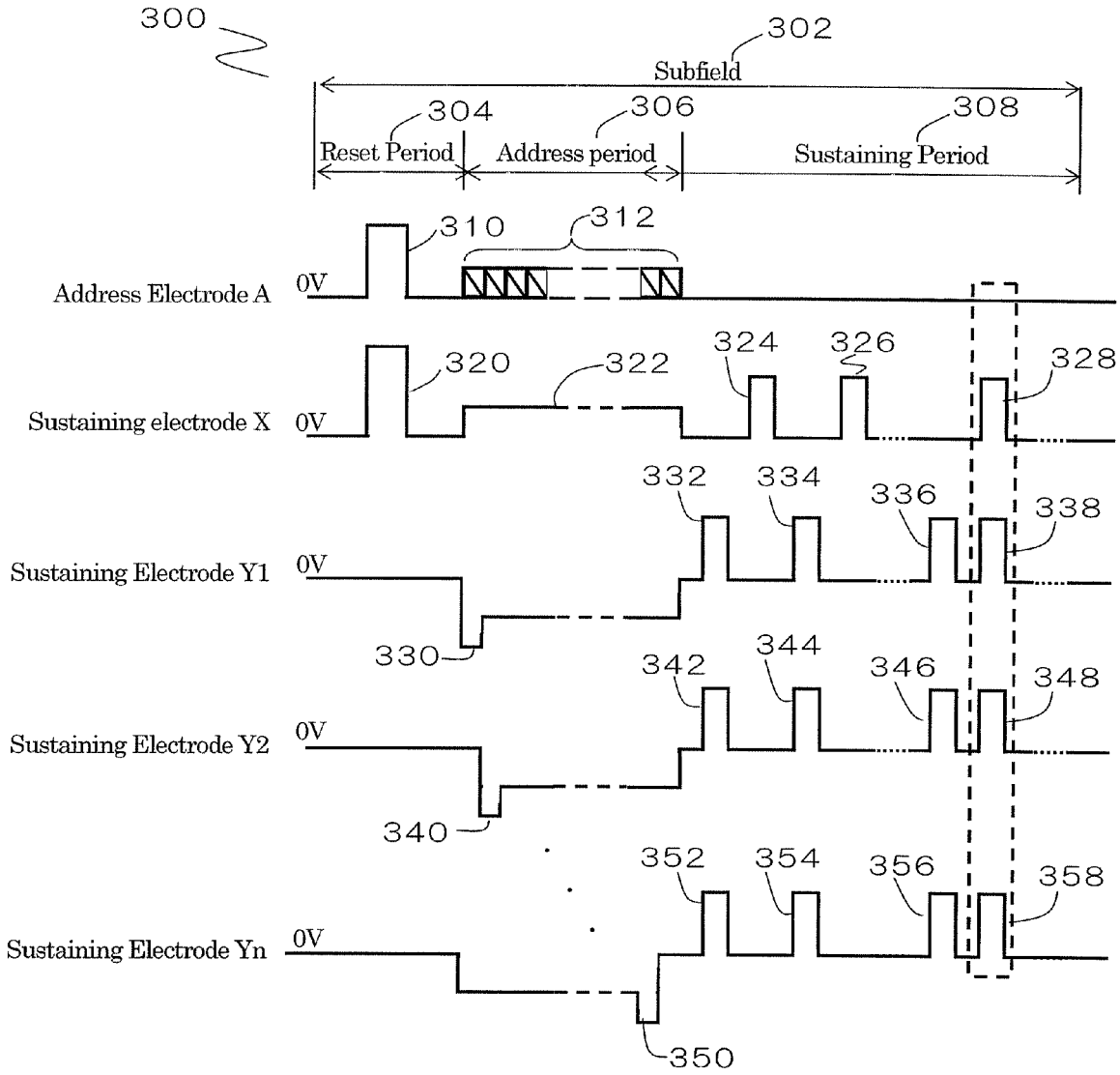
FIG. 5 shows waveforms of voltage applied to each of the address and sustaining electrodes.

FIG. 5 shows a waveform of voltages applied to the address electrode 12 (also referred to as address electrode A), the sustaining electrodes X 13 and Y 14 (also referred to as sustaining electrode X and Y) composing a pair of the pair of display electrodes 15. Referring FIGS. 4 and 5, the details of voltages applied to the electrodes are explained.

During the reset period 304 shown in FIG. 5, the driving unit 210 applies to the sustaining electrode X a positive writing pulse 320 of which peak value is higher than the surface discharge start voltage (the discharge start voltage between the sustaining electrodes X and Y composing the pair of display electrodes), while the positive voltage is applied to all address electrodes A at the same time. Corresponding to the rise of the wiring pulse 320, strong surface discharges are generated at all lines. The resultant wall charges are accumulated once in the dielectric layer at the side of the front substrate 20, where the dielectric layer corresponds to the portion which is a part of the glass tube of the gas discharge tube 10 and contacts to the front substrate 20. Corresponding to the fall (or decay) of the writing pulse 320, the wall charge in the dielectric layer, however, disappears, because of the so-called self discharge caused by the wall charge. The pulse 310 is applied to prevent the wall charge from accumulating on the dielectric layer of the tube of the rear substrate 30, where the dielectric layer corresponds to the portion of the glass tube which contacts to the rear substrate 30.

The address period 306 is a period in which a line-sequential addressing is executed. The sustaining electrode X is biased to a positive potential, such as +50V, to the ground, and all the sustaining electrodes Y 14 which is one of each of the pairs of display electrodes 15 are biased to a negative potential, such as −70V. In this state, the line is selected every line from the first line L (corresponding to the sustaining electrode Y1), and then a scanning pulse of negative potential is applied to the selected sustaining electrode Y 14 sequentially. The potential of sustaining electrode Y 14 as the selected line L is temporarily biased to a negative potential, such as −170 V. At a time of the selection of the line L, a positive address pulse 312 of the peak value such as +60V is applied to the address electrode A corresponding to the cell to be lit. In the selected line L, the address discharge between the sustaining electrode Y 14 and address electrode A 12 corresponding to the cell to which the address pulse 312 is applied is generated. The discharge between the sustaining electrode X 13 and the address electrode A 12 is not generated, because the sustaining electrodes X 13 is biased to the potential of same polarity of the address pulse 312 and the potential difference between the address electrode A 12 and the sustaining electrode X 13 is decreased.

The bias potential of the sustaining electrode X 13 is set so as that the voltage difference between the sustaining electrode X 13 and the sustaining electrode Y 14 is lower than the surface discharge start voltage for preventing the wall charge from accumulating on the dielectric layer close to the non-selected cells. The surface discharge start voltage is usually higher than the discharge start voltage to generate the discharge between the sustaining electrode Y and the address electrode A.

The sustaining period 308 is the period in which the light-emitting state of the cell selected during the address period is kept to achieve the brightness corresponding to the desired gray scale level. The voltage-waveforms applied to the sustaining electrodes Y 14 (sustaining electrodes Y1-Yn) and the sustaining electrodes X 13 except ones enclosed by dotted line in FIG. 5 are similar to the conventional voltage waveforms applied to the sustaining electrodes. As shown in FIG. 5, the pluses such as 332, 342, . . . , 352 and 324 of positive polarity similar to the conventional voltage-waveforms are applied to the sustaining electrodes Y 14 and X 13 alternately, and the surface discharges are performed in the cells selected during the address period.

Next the one of the characteristics of the present preferred embodiment is explained. The characteristic is in that the opposed discharge between sustaining electrode X and the address electrode A is performed during the sustaining period 308, where the opposed discharge is generated in a time indicated by the dotted line in FIG. 5. Shortly before the time enclosed by the dotted line, the surface discharges are generated between the sustaining X and the sustaining electrodes Y1-Yn each of which composes the pair of sustaining electrodes and receives the pulses having the positive polarity 336, 346, . . . , 356 respectively. By these surface discharges, the positive wall charges are accumulated in the portions close to the sustaining electrodes X of cells selected during address period, while the negative wall charges are accumulated in the portions close to sustaining electrodes Y1-Yn of cells selected. In this state of charge distribution, applying a positive pulse 328 to the sustaining electrode X, the superposition of the positive wall charge on the sustaining electrode X and the applied voltage results in the generation of the opposed discharge between the sustaining electrode X and the address electrode A which are corresponding to the cell selected during the address period, because of the potential difference between the sustaining electrode X and the address electrode A exceeds the surface discharge start voltage by the superposition.

At the same time when the positive pulse 328 is applied, each of the positive pulses 338, 348, . . . , 358 is applied to each of the sustaining electrodes Y1-Yn. The positive pulses 338-358 effect the cancellation or decrease of influence caused by the negative charges accumulated at the portions close to each of the sustaining electrodes Y1-Yn, and then the surface discharges between the sustaining electrodes Y1-Yn and the sustaining electrode X composing a pair with them can be prevented.

Accordingly since the opposed discharges are generated it the portion enclosed by the dotted line, the cells selected during the address period glow. The intensity of light emitted from the sells is lower than that caused by the sustaining discharge between a pair of the display electrodes, because the distance between the sustaining electrode X and the address electrode A is longer than the distance between the sustaining electrodes X and Y, and the accumulation of the wall charge on the inner surface of the glass tube near to the address electrode A has difficulty for the fluorescent material disposed near to the address electrode A.

Thus light glow from the fluorescent material by using the opposed discharge shown in FIG. 5 realizes the intensity of light lower than that caused by the sustaining discharge between the pair of display electrodes 15. In the present embodiment, the address electrode 12 is used to generate the intermediate gray scale level between the levels realized in the gray scale level generated by the conventional driving method in which the address electrode is used for the address discharge to select the cells to be lit. The present embodiment, that is, uses the phenomena in which the intensity of the light caused by the single discharge between the address electrode A and the sustaining electrode X as one of the pair of the display electrodes 15 is lower than the intensity of the light caused by the single sustaining discharge between the pair of the display electrodes 15. In the present embodiment, accordingly the relative intensity of light caused by the discharge between the address electrode A and one of the pair of display electrodes 15 is lower than 1, assuming that the relative intensity of light caused by the discharge between the pair of the display electrodes in sustaining period is 1, because the distance between the address electrode A and one of the pair of the display electrodes is longer than the distance between both electrodes of the pair of display electrodes and the amount of charge which is caused by a discharge and accumulated at the portion close to the address electrode is less than that caused by the discharge between the pair of the display electrodes.

Thus, as the intensity of the light caused by the sustaining electrode X and the address electrode A is lower than that caused by the discharge between the pair of the display electrodes 15, therefore it is possible to assume that the intensity of light caused by the sustaining electrode X and the address electrode A is 0.5. Then, the gray-scale display levels to be display and the number of discharges to achieve the gray-scale display levels by the conventional discharge between the pair of display electrodes and by the discharge between the address electrode and the one of the pair of the display electrodes is shown in Table 1, where the number of conventional discharges by the pair of the display electrodes for obtaining the levels is also shown. Comparing both the gray-scale display levels to be achieved, the method of the present embodiment can realize finer levels, such as 0.5 and 1.5, than that obtained by the conventional discharge and can increase the number of levels.

TABLE 1

| The gray scale levels to be displayed and the number of discharges to achieve the level | | | |
|---|---|---|---|
| | | the number of glows by the method of the present embodiment | |
| the gray-scale levels to be displayed (relative) | the number of glows by the conventional method | the number of surface discharges | the number of discharges between the display electrode and the address electrode |
| 0 | 0 | 0 | 0 |
| 0.5 | not achieved | 0 | 1 |
| 1 | 1 | 1 | 0 |
| 1.5 | not achieved | 1 | 1 |
| 2 | 2 | 2 | 0 |
| 2.5 | not achieved | 2 | 1 |

The table 1 shows that the method of the present embodiment can realize finer levels than those by the conventional methods, especially the present method effects the levels at the range of lower level, because the difference of brightness in the range of lower level, such as the variance in the difference between levels 2 and 3 and the difference between levels 2 and 2.5, can be more clearly distinct than the same difference of brightness in the range of higher level, such as the variance in the difference between levels 254 and 255 and the difference between levels 254 and 254.5.

Second Embodiment

Figure 6:
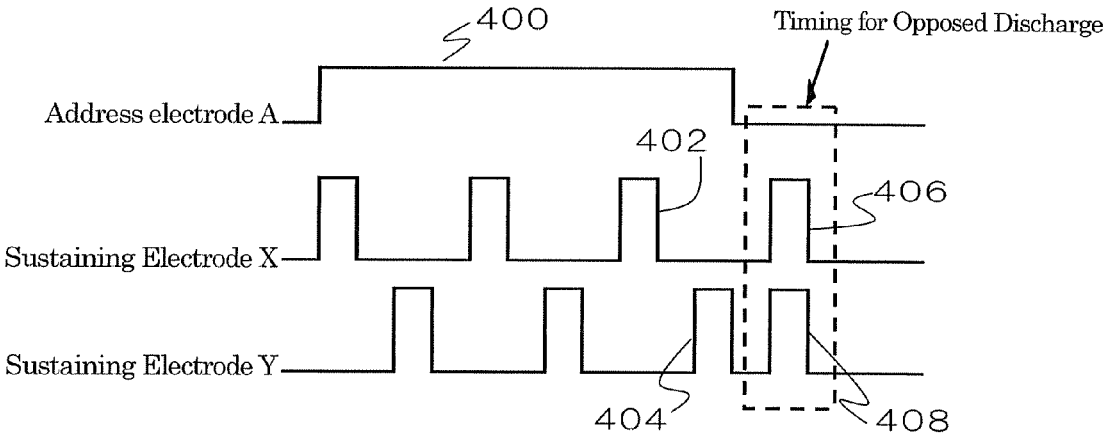
FIG. 6 shows waveforms for a second embodiment.

FIG. 6 shows the essential part in the second embodiment. In FIG. 6, the voltage waveforms are shown which are applied to address electrode A 12, sustaining electrode X 13, and the sustaining electrodes Y 14 respectively during the sustaining period, where the sustaining electrodes Y 14 in FIG. 6 is representatively shown as one of the sustaining electrodes Y which are addressed.

The gas-discharge-tube array and the gas discharge display apparatus shown in the first embodiment can be used also in the second embodiment. Next the second embodiment is explained in view of the difference from the first embodiment.

In the second embodiment, a positive offset voltage 400 is applied to the address electrode A to prevent the opposed discharge between the address electrode and the sustaining electrodes X or Y during performing the surface discharge between the sustaining electrodes X and Y. And the offset voltage applied to the address electrode A is controlled to 0V when the opposed discharge between the sustaining electrode X and the address electrode A is performed in the timing enclosed with the dotted line in the same manner shown in the first embodiment. Accordingly, the discharge between the sustaining electrode X and the address electrode A is surely performed.

The method of driving in the second embodiment realizes the sure performance of the surface discharge and the opposed discharge.

Third Embodiment

Figure 7:
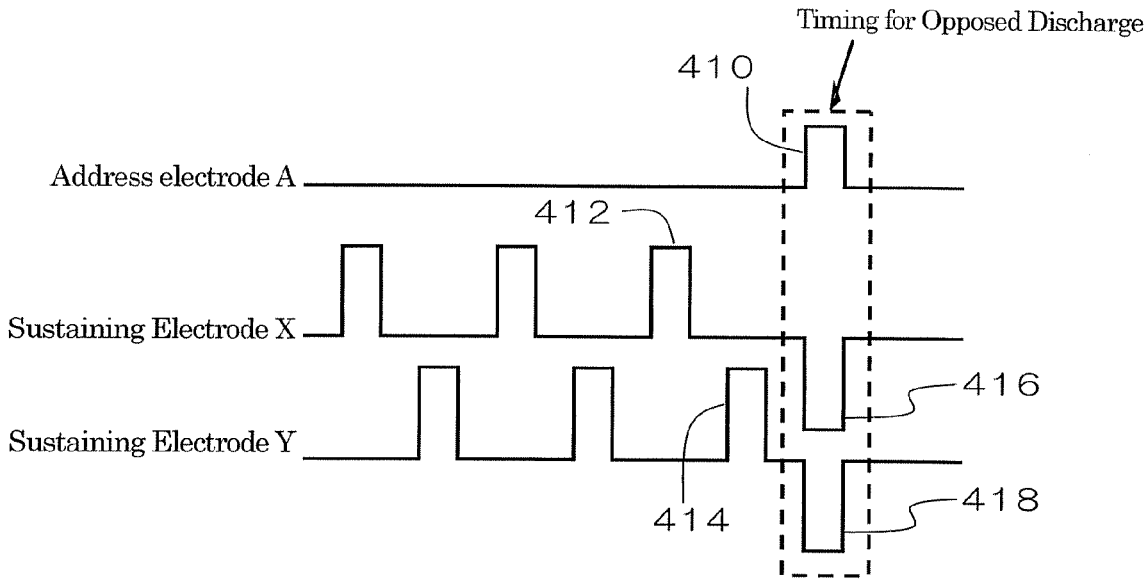
FIG. 7 shows waveforms for a third embodiment.

FIG. 7 shows the essential part in the third embodiment. In FIG. 7, the voltage waveforms are shown which are applied to address electrode A 12, sustaining electrode X 13, and the sustaining electrodes Y 14 respectively during the sustaining period (see FIG. 5), where like as shown in FIG. 6, the sustaining electrodes Y 14 in FIG. 7 is representatively shown as one of the sustaining electrodes Y which are addressed.

The gas-discharge-tube array and the gas discharge display apparatus similar to that shown in the first embodiment apparatus can be used as ones in the third embodiment. Next the third embodiment is explained in view of the differences from the first and second embodiments.

In the first and second embodiments, positive pulses are used as voltages applied to the sustaining electrodes when the opposed discharges are generated. However, the third embodiment shows that a negative pulse instead of a positive pulse can be used as a voltage applied to sustaining electrode to generate an opposed discharge. The opposed discharge is generated at the timing enclosed by the dotted line, where the opposed discharge is caused by the pulse 410 applied to the address electrode A and the pulse 418 applied to the sustaining electrode Y. That is, the sustaining discharge (the surface discharge) between the sustaining Y and X is generated when the pulse 414 is applied to the sustaining electrode Y, after the surface discharge caused by the pulse 414 the positive wall charge is accumulated on the portion which is associated with the selected cell and close to the sustaining electrode X and the negative wall charge is accumulated the portion close to the sustaining electrode Y corresponding to the cell selected during the addressing period. In the state of the wall-charge distribution, the positive pulse 410 is applied to the address electrode A and the negative pulses 416 and 418 are applied to the sustaining electrodes X and Y. Since the negative wall charge is accumulated on the portion close to the sustaining electrode Y as described above, the effective potential difference between potentials of the address electrode A and the sustaining electrode Y exceeds the potential difference to make the opposed discharge start, the opposed discharge is generated. On the other hand, the negative pulse 416 also is applied to the sustaining electrode X. The discharges, however, are not generated between the sustaining electrodes X and Y, and between the sustaining electrode X and the address electrode A, because the positive wall charge accumulated on the portion close to the sustaining electrode X decreases the effective potential of the portion.

The Fourth Embodiment

Figure 8:
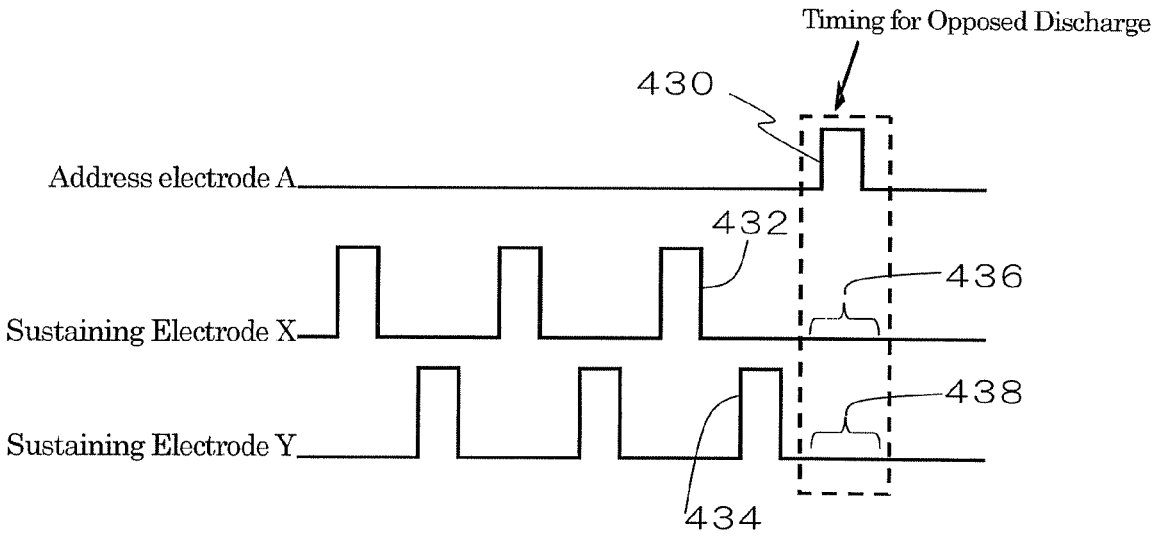
FIG. 8 shows waveforms for a fourth embodiment.

FIG. 8 shows the essential portion in the fourth embodiment. In FIG. 8, the voltage waveforms applied during the sustaining period (see FIG. 5) to each of the address electrode 12 and the sustaining electrodes 13 and 14 are shown, where like as shown in FIG. 6, the sustaining electrodes Y 13 is representatively shown as one of the sustaining electrodes Y which are addressed.

The gas-discharge-tube array and the gas discharge display apparatus shown in the first embodiment can be used also in the fourth embodiment. Next the fourth embodiment is explained from the view point of the difference from the first, the second, and the third embodiments.

In the fourth embodiment, the opposed discharge between the address electrode A and the sustaining electrode Y is generated by the application of a positive pulse 430 to the address electrode A, while the opposed discharges are generated by the application of the positive or negative pulses to the sustaining electrodes in the first to third embodiments.

As shown in FIG. 8, the application of positive pulse 434 to the sustaining electrode Y causes in the cells selected (or addressed) the surface discharge between the sustaining electrodes X and Y, and at the timing 436 enclosed by the dotted line the positive wall charge is remained in the portion close to the sustaining electrode X and the negative wall charge also is remained in the portion close to the sustaining electrode Y at the timing 438. In this state of the wall charge distribution, the potential of the sustaining electrode Y is effectively negative by the wall charges at the timing 438, and at the same timing the a positive pulse 430 is applied to the address electrode A. Value of the pulse 430 is set to the voltage so that the potential difference between the effective potential of the sustaining electrode Y and the potential of the pulse 430 becomes more than the surface discharge start voltage. Accordingly, when the pulse 430 is applied to the address electrode A, the opposed discharge is generated between the address electrode A and the sustaining electrode Y. However, the discharge between the sustaining electrode X and the address electrode A is not generated even if the pulse 430 is applied to the address electrode A, because the effective potential of the sustaining electrode X is positive during the timing 436 by the accumulation of the positive charge at the portion close to the sustaining electrode X and the potential difference between the address electrode A and the sustaining electrode X is lower than the opposed discharge start voltage. Accordingly, the method of driving described above also realizes the glow having the intensity of light different from and usually lower than that caused by the surface discharge between a pair of sustaining electrodes.

The Fifth Embodiment

Figure 9:
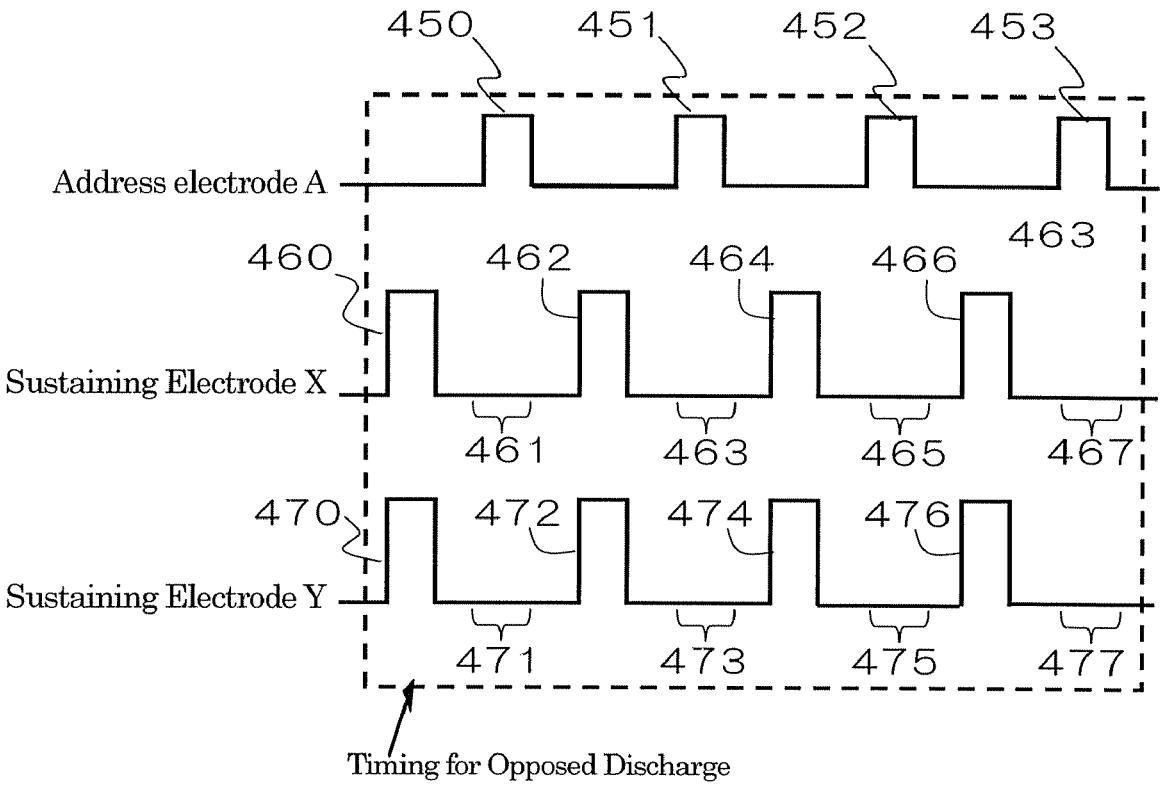
FIG. 9 shows waveforms for a fifth embodiment.

FIG. 9 shows the essential portion in the fifth embodiment. In FIG. 9, the voltage waveform applied to each of the address electrode 12 and the sustaining electrodes 13 and 14 during the sustaining period (see FIG. 5) are shown, where like as shown in FIG. 6, the sustaining electrodes Y 13 is representatively shown as one of the sustaining electrodes Y which are addressed.

The gas-discharge-tube array and the gas discharge display apparatus shown in the first embodiment can be used also in the fifth embodiment. Next the fifth embodiment is explained from the view point of the difference from the first, the second, the third, and the fourth embodiments.

In the first, second, third, and fourth embodiment, the opposed discharge is generated once during the sustaining period, while a plurality of the opposed discharges can be generated in the same sustaining period based on the disclosed descriptions of the embodiments. The essential part of the fifth embodiment is in the successive generation of a plurality of the opposed discharges and the glows by the discharges during the sustaining period.

In FIG. 9, the opposed discharges are generated at the timing enclosed by the dotted line. The explanation on the fifth embodiment is directed in the case where the positive wall charge is accumulated at the portion close to the sustaining electrode X before the application of the pulse 460 and the negative wall charge is accumulated at the portion close to the sustaining electrode Y before the application of the pulse 470. Next to the state described above, when the positive pulse 460 is applied to the sustaining electrode X, the effective potential of the sustaining electrode X increases by the positive wall charge and can exceed the opposed discharge start voltage between the address electrode A and the sustaining electrode X. Then the discharge is generated between the address electrode A and the sustaining electrode X and the light glows in the cell corresponding to the discharge. However the opposed discharge between the address electrode and the sustaining electrode Y is not generated, because the effective potential of the sustaining electrode Y is kept at the voltage lower than the opposed discharge start voltage by the negative wall charge at the portion close to the sustaining electrode Y.

At around the timing 461 after termination of the opposed discharge caused by the pulse 460, since the negative wall charge is accumulated at the portion close to the sustaining electrode X, the effective potential of the sustaining electrode X is negative. At the timing, applying the positive pulse 450 to the address electrode A can increase the potential difference between the address electrode A and the sustaining electrode X up to the voltage higher than the opposed discharge start voltage. Then the opposed discharge between the address electrode A and the sustaining electrode X can be generated and the light from the cell corresponding to the discharge (or the cell elected) is emitted.

However, at around the timing 471 corresponding to the timing 461, the wall charge accumulated at the portion close to the sustaining electrode Y is negative charge, and the amount of the wall charge is less than that the portion close to the sustaining electrode X. Accordingly the potential deference between the address electrode A and the sustaining electrode Y does not reach to the opposed discharge start voltage.

In addition, to prevent perfectly the opposed discharge between the address electrode A and the sustaining electrode Y, it may be preferable to apply a positive pulse to sustaining electrode Y at around the timing 471. But value of the positive pulse must be set to the value at which the sustaining discharge between the sustaining electrode X and Y is not generated.

By the process described above, the opposed discharges can be repeated (successively) and the gray scale level corresponding to light intensity achieved by the repeated opposed discharges can be realized.

The Sixth Embodiment

Figure 10:
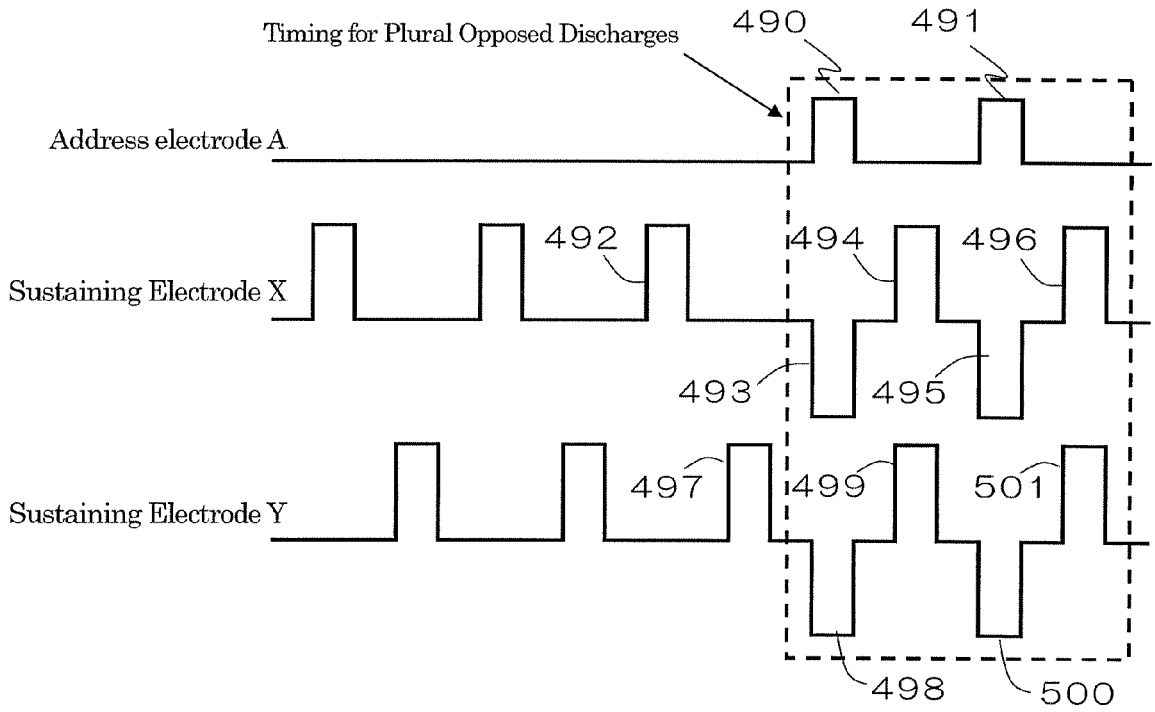
FIG. 10 shows waveforms for a sixth embodiment.

FIG. 10 shows the essential portion in the sixth embodiment. In FIG. 10, the voltage waveforms applied during the sustaining period (see FIG. 5) to each of the address electrode 12 and the sustaining electrodes 13 and 14 are shown, where like as shown in FIG. 6, the sustaining electrodes Y 13 is representatively shown as one of the sustaining electrodes Y which are addressed.

The gas-discharge-tube array and the gas discharge display apparatus shown in the first embodiment can be used also in the sixth embodiment. Next the sixth embodiment is explained from the view point of the difference from the first, the second, the third, and the fourth embodiments.

In the first, second, third, and fourth embodiments, the opposed discharge is generated once during the sustaining period, while a plurality of the opposed discharges can be generated in the same sustaining period based on the descriptions of the embodiments. The essential part of the sixth embodiment is successive generations of a plurality of the surface discharges, the opposed discharges and the glows by the discharges during the sustaining period.

In FIG. 10, the surface discharge between the sustaining electrodes X and Y is generated by the application of positive pulse 497 to the sustaining electrode Y. Thereafter successive opposed discharges are generated within the timing enclosed with the dotted line. After applying the pulse 497, the negative pulses 493 and 498 are applied to the sustaining X and Y respectively as shown in FIG. 10. On the termination of the surface discharge by the pulse 497, the negative wall charge is accumulated at the portion close to the sustaining electrode Y, while the positive wall charge is accumulated at the portion close to the sustaining electrode X. Accordingly, the effective potential of the sustaining electrode X is smaller than value of the pulse 493 (the absolute effective voltage of applying to the sustaining electrode X is lower than the absolute value of the pulse 493), while the effective potential of the sustaining electrode Y is larger than value of the pulse 498 (the absolute effective voltage of the applying to the sustaining electrode Y is larger her than the absolute value of the pulse 498). At the same time of applying the pulses 493 and 498, the positive pulse 490 is applied A, then the potential difference between the potentials of the address electrode and the sustaining electrode Y increases over the opposed discharge start voltage, in other words, the value of the pulse 490 is set so as to exceed the opposed discharge start voltage. Accordingly, the opposed discharge between the address electrode A and the sustaining electrode Y is generated.

The opposed discharge results in the positive wall charge accumulation at the portion near to the sustaining electrode Y, therefore the effective potential of the successive pulse 499 applied to the sustaining electrode Y is higher than value of the pulse 499. The effective potential becomes higher than the opposed discharge start voltage for the opposed discharge between the address electrode A and the sustaining electrode Y, and the opposed discharge between the both electrodes is generated.

On the sustaining electrode X, the pulse 497 effects in generation of the surface discharge between the sustaining electrodes X and Y and the accumulation of the positive charge at the portion close to the sustaining electrode X. Accordingly, the effective potential of the sustaining electrode X becomes lower than the voltage of the pulse 493 (that is, the effective potential becomes close to 0V.), then the discharge between the sustaining electrode X and the address electrode A is not generated by the pulse 493.

The embodiments described above, the gas discharge display apparatus having the gas-discharge tube are explained. The embodiments can easily be applied to the color display apparatus by composing the cell as a pixel with three gas discharge tubes, in each of which the fluorescent materials emitting the light of red, green, or blue is disposed respectively. Further, instead of the gas-discharge-tube display array, the present invention can be applied to an apparatus having the plasma display panel of the triple electrode surface discharge type which composes the front substrate, the rear substrate, the ribs for defining the space between the front and the rear substrates, the fluorescent material disposed between the ribs where the a plurality of the pairs of display electrodes are formed on inner surface of the front substrate and a plurality of the address electrodes disposed between the ribs in the direction to be orthogonal to the direction of the display electrodes, and the discharge gas filled within the space enclosed by the front and rear substrates.

The present invention provides the method of driving and the apparatus for gas discharge display apparatus in which the opposed discharge between the sustaining electrode and the address electrode in addition to the conventional surface discharge are generated for the light emission from the fluorescent. The method and the apparatus effect improvements in finer gray scale levels than those by conventional methods and apparatus.

What is claimed is:

1. A method of driving a gas discharge display apparatus having a plurality of light emitting tubes, a plurality of address electrodes extending in a longitudinal direction of the light emitting tube, and a plurality of pairs of display electrodes extending in an orthogonal direction to the address electrode, the pairs of the display electrodes opposing to the address electrodes via the light emitting tube, the method comprising:

selecting a cell by a first discharge between one of a pair of display electrodes and a selected one of the address electrodes in an address period, the cell being a part of the light emitting tube and being defined as a cross portion of the selected pair of display electrodes and the selected address electrode; and emitting a light from a fluorescent material in the cell in a sustaining period, the light emitting being caused by a second discharge generated between the pair of display electrodes in a first portion of the sustaining period and at least one of a third discharge generated between either one of the pair of display electrodes and the address electrode in a second portion of the sustaining period that is after the first portion of the sustaining period;

wherein the third discharge in the second portion of the sustaining period is performed while preventing the second discharge by applying voltage having a same polarity to each of the pair of display electrodes concurrently.

2. The method according to claim 1, wherein the third discharge in the second portion of the sustaining period is generated by an application of a pulse to the address electrode.

3. The method according to claim 2, wherein the third discharge in the second portion of the sustaining period is generated by an application of a positive pulse of a peak value being equal to or more than a peak value of a pulse applied to the selected address electrode for generating the first discharge.

4. A method of driving a gas discharge display apparatus capable of displaying an image in one field which is composed of a plurality of subfields, the gas discharge display apparatus having an array of a plurality of light emitting tubes, a plurality of address electrodes extending in a longitudinal direction of the light emitting tubes, and a plurality of pairs of display electrodes extending in an orthogonal direction to the address electrodes, the pairs of the display electrodes opposing to the address electrodes via the light emitting tubes, the method of driving at least one subfield comprising:

selecting a cell by a first discharge between one of a pair of display electrodes and a selected one of the address electrodes in an address period, the cell being a part of the light emitting tube and being defined as a cross portion of the selected pair of display electrodes and the selected address electrode; and emitting a light from a fluorescent material in the cell in a sustaining period, the light emitting being caused by a second discharge generated between a pair of display electrodes in a first portion of the sustaining period and at least one of a third discharge between either one of the pair of display electrodes and the address electrode in a second portion after the first portion of the sustaining period of the subfield; and further comprising at least one further subfield in which the light emitting being caused by third discharge occurs while preventing the second discharge by applying voltage having a same polarity to each of the pair of display electrodes concurrently.

5. A method of driving for displaying a gray scale image on a gas discharge display apparatus having an array of a plurality of light emitting tubes, a plurality of address electrodes extending in a longitudinal direction of the light emitting tubes, and a plurality of pairs of display electrodes extending in an orthogonal direction to the address electrode, the pairs of the display electrodes opposing to the address electrodes via the light emitting tubes, the method comprising:

at least one subfield composing an address period and a sustaining period;

generating a series of a predetermined number of a surface discharge between a pair of display electrodes during a first portion of the sustaining period; and generating at least one of an opposed discharge between either one of a pair of display electrodes and the address electrode, in a second portion of the sustaining period that is after the first portion of the sustaining period, the opposed discharge being weaker than the surface discharge;

wherein, when the opposed discharge is generated between one of the pair of the display electrodes and the address electrode during the second portion of the sustaining period, voltage having a same polarity is concurrently applied to each of the pair of the display electrodes for preventing the surface discharge generated between the pair of the display electrodes.

6. The method according to claim 5, wherein, the opposed discharge is generated at least once during the second portion of the sustaining period by applying a positive pulse to the address electrode between the one of the pair of display electrodes and the address electrode.

7. The method according to claim 5, further comprising:

at least two subfields each composing an address period and a sustaining period;

during the sustaining period in a first one of the subfields, a plurality of surface discharges only generated between the pair of the display electrodes; and during the sustaining period in a second one of the subfields, in series, a surface discharge generated between the pair of the display electrodes, and an opposed discharge generated between the one of the pair of display electrodes and the address electrode, wherein the brightness of the opposed discharge is less than a brightness of the surface discharge.

8. The method according to any one of the claims 5 to 7, wherein the opposed discharge at least once generated during the second portion of the sustaining period is generated between one of the pair of display electrodes which is not used as any scanning electrode during the address period, and the address electrode.

* * * * *